United States Patent [19]

Sakai et al.

[11] 4,203,297

[45] May 20, 1980

[54] GOVERNING SYSTEM FOR USE IN SLIDING-PRESSURE TYPE TURBINE POWER PLANT

[75] Inventors: Akira Sakai, Tokyo; Jube Matsumura, Hitachi, both of Japan

[73] Assignee: Hitachi, Ltd., Japan

[21] Appl. No.: 910,346

[22] Filed: May 30, 1978

[51] Int. Cl.[2] ..... F01K 13/02

[52] U.S. Cl. ..... 60/660; 290/52

[58] Field of Search ..... 290/52; 60/660, 664, 60/665, 667

[56] References Cited

U.S. PATENT DOCUMENTS

| | | | |
|---|---|---|---|
| 3,097,488 | 7/1963 | Eggenberger | 60/660 |
| 3,545,207 | 12/1970 | Barber | 60/664 |
| 4,120,159 | 10/1978 | Matsumoto | 60/667 |

*Primary Examiner*—Allen M. Ostrager

*Attorney, Agent, or Firm*—Craig & Antonelli

[57] ABSTRACT

A governing system for use in a sliding-pressure type turbine power plant, in which a target level for a main steam pressure is automatically set in response to a load demand, while two or more regulating valves are controlled according to a valve-positioning signal so as to eliminate a deviation of an actual load from a load demand, whereupon a target level for the main steam pressure is corrected, based on the diviation of the actual opening from the target opening of each regulating valve, whereby the main pressure generated in a boiler is regulated to a corrected target level. This governing system includes a valve driving mechanism functioning such that all regulating valves be opened at a time in a range up to a given opening, and thereafter the regulating valves be opened one after another, commensurate to the magnitude of a control signal, after entering a range beyond the aforenoted given opening.

7 Claims, 8 Drawing Figures

GOVERNING SYSTEM FOR USE IN SLIDING-PRESSURE TYPE TURBINE POWER PLANT

This invention relates to a control system for use in a turbine power plant, and more particularly to a governing system which controls the openings of two or more regulating valves for use in a sliding-pressure type steam turbine power plant The types of the governing systems for use in turbine power plants are generally classified into:

(a) a nozzle governing system which has widely found its use in the United States of America and Japan, and in which two or more regulating valves are opened one after another, even in the case of a partial load condition, and a load for a main steam pressure may be controlled by varying a nozzle area at a constant rated-pressure; and (b) a throttle governing system which has generally found its use in West Europe, particularly in West Germany, and in which two or more regulating valves are opened and closed at a time, and in addition the main steam pressure is lowered, as a load is lowered down to a partial load level, the load being controlled by varying the pressure at a constant nozzle area.

The nozzle governing system (a) is superior, in internal efficiency of a turbine, even in the case of a partial load, to the throttle governing system (b). However, in case the turbine is operated at a constant main steam pressure, there results an increase in power loss in a water-feeding pump for a boiler, in a partial load condition, so the efficiency of the plant in its entirety is progressively lowered, as the load is being lowered to a partial load level. In addition, in the partial load condition, the flow rate of the main steam is reduced, thus impairing the load-followability of the plant.

On the other hand, improvements may be expected for a plant efficiency in a partial load condition, if resorted to the sliding-pressure type system of a turbine, in which the main steam pressure is varied in response to a load demand. It follows from this that if resorted to both the sliding-pressure type system and the nozzle governing system, then the plant efficiency is further improved, in a partial load condition, due to the improvements in internal efficiency of the turbine.

Two types of sliding pressure systems have been proposed i.e.; one in which a boiler is so controlled that the main steam pressure is set to a target pressure level, while the opening of each regulating valve is so controlled as to eliminate the deviation of a main steam pressure from a target pressure level; and the other, in which a target value for the openings of each regulating valves is preset, so that the target level for a main steam pressure in response to a load demand is determined, commensurate to the target value for an opening of each valve, while the opening of each regulating valve is controlled according to the deviation of an actual output of a plant from a load demand, and then the target level for a main steam pressure is corrected, based on a deviation of the actual opening of each regulating valve from the target value, thereby controlling a boiler. The latter case is introduced in "Operation result of Sliding-Pressure Thermal Power Plant, Ohi No. 3" in pages 11 to 18 of the magazine "KARYOKU GENSHIRYOKU HATSUDEN" Vol. 27, No. 4, published in April, 1976, in Japan. In case the running system such as the latter is adopted for the nozzle governing system, then the following problems are encountered:

It is known that the internal efficiency of a turbine reaches its peak, when a plant is run, without setting any one of two or more regulating valves to an intermediate opening. It has been a common practice, therefore, that a target value for an opening of each regulating valve is set to a change-over point, wherein for instance the regulating valves covered in a range up to the 'n'th valve are fully opened, while the valves succeeding thereto are fully closed. However, a loading system for a turbine power plant suffers from a small variation in frequency, so that the control of a load fringe is conducted by controlling the opening of each regulating valve. Accordingly, in case the opening of each regulating valve is set in the aforenoted manner, then the 'n+1'th regulating valve repeats opening and closing cycles at a small amplitude. As a result, there is created thermal stresses in the neighborhood of the nozzles leading to the regulating valves. In addition, there arises a liklihood of errosion being caused in valve seats of regulating valves.

It is a principal object of the present invention to provide a turbine governing system for use in a turbine power plant, which may avoid the aforenoted shortcomings experienced with the prior art systems of the type described, even in case control signals for the openings of regulating valves flactuate on a short cycle in the neighborhood of change-over points of valves.

The turbine governing system according to the present invention features that two or more regulating valves are set at least to a level exceeding a given warming opening, respectively, in response to a valve positioning signal, while the valves are opened one after another in an opening range beyond the aforenoted range, i.e., a range beyond a given warming opening. In other words, two or more regulating valves behave in a manner similar to those in a nozzle governing system in general, although valves succeeding thereto have been opened in a range up to a given warming opening, so that there arises no problem even in case a valve-positioning signal flactuates in the neighborhood of a valve changeover point.

FIG. 1 shows a block diagram of a sliding-pressure type plant control system, to which the present invention is applied.

Figure 1:
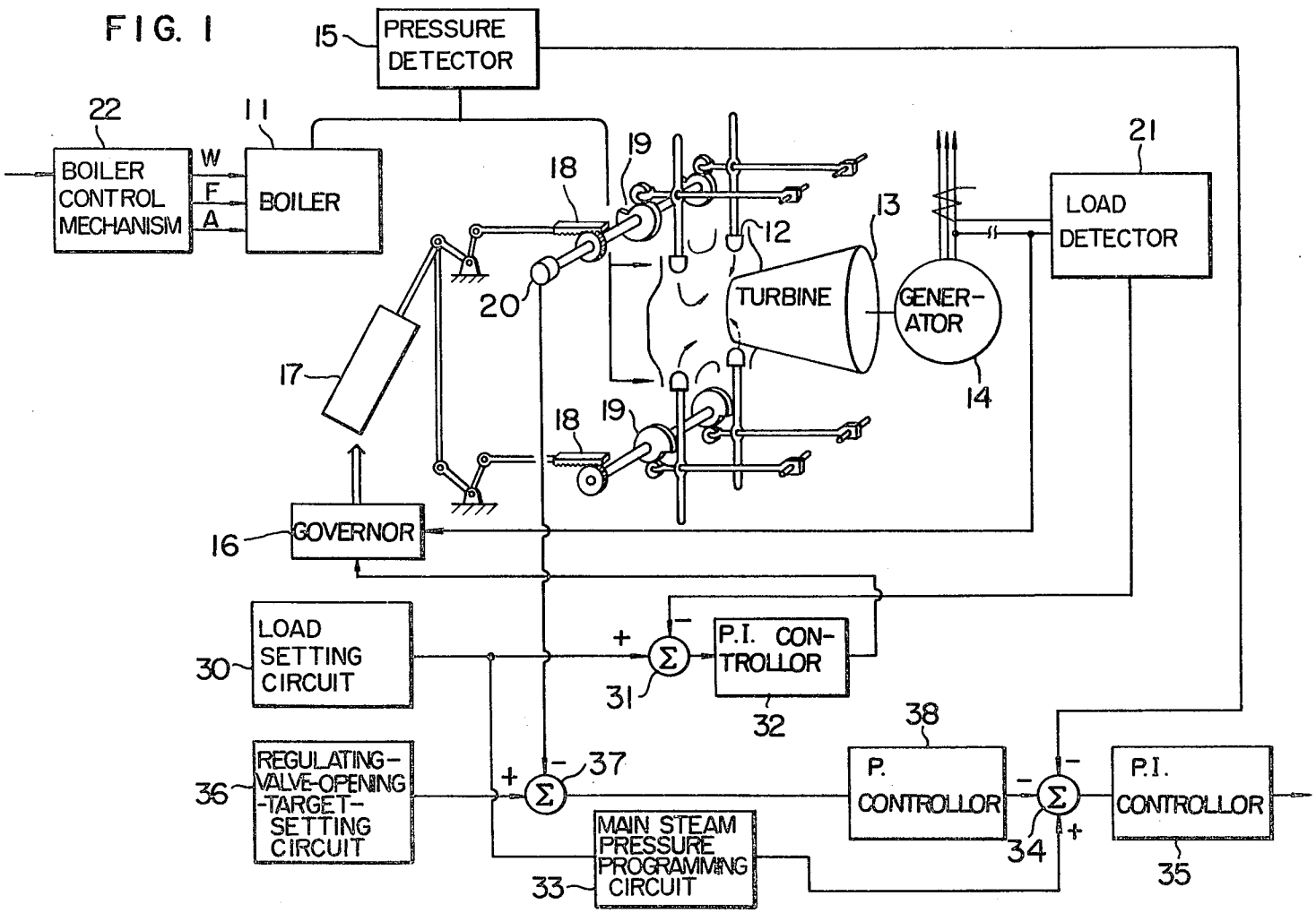
FIG. 1 is a block diagram illustrative of one embodiment of the invention.

Steam from a boiler 11 is delivered via a turbine-regulating valve 12 into a steam turbine 13, which is directly connected to an electric generator 14. Shown at 15 is a pressure detector adapted to detect a main steam pressure in the boiler 11. Shown at 16 is a governor which is connected via a hydraulic circuit to piston 17 for driving each turbine regulating valve, so that the movement of the piston 17 is transmitted through the medium of a rack and pinion mechanism 18 to a cam 19 so as to rotate same. Accordingly, two or more regulating valves 12 are opened and closed according to the characteristic of the cam 19. The movement of a shaft secured to the regulating-valve cam 19 is detected by a detector 20 for detecting an angular position of the shaft of the regulating-valve cam. Shown at 21 is a generator-load detector, and at 22 a boiler control mechanism for controlling the main steam pressure therein.

The operation of the control circuit will be described hereinafter. An output of a load-setting circuit 30, in which a load has been set by an operator in a central electric power feeding station or a power plant, is compared in an adder 31 with an actual load detected by the load detector 21, and then a deviation derived is added to a proportional plus integral control circuit 32, whose output operates a governor motor so as to operate regulating valves 12 via piston 17, mechanism 18 and cam 19 for controlling the flow rate of steam into the turbine 13 so as to bring the actual load on the generator into coincidence with a preset load value. The aforenoted control is conducted at a relatively high speed (not shorter than several tens seconds). On the other hand, a speed feedback signal derived by an output voltage of a generator is fed to the governor 16, and thus the control for a load fringe due to the fluctuation in system-frequency is conducted by the governor.

On the other hand, such an output of a main steam pressure programming circuit 33, which has been derived as a function of a preset load value, is compared in the adder 34 with an actual pressure detected by the main steam pressure detector 15, and then a deviation derived is added to the proportional plus integral control circuit 35, whose output operates the boiler control mechanism, whereby a water feeding amount, fuel feeding amount, and air quantity are controlled, with the result that the main steam pressure is controlled so as to match with an target level which has been programmed beforehand. (The control speed is relatively slow, say, on the order of several minutes.)

An actual regulating-valve-cam-shaft-angle signal detected by the detector is compared by a comparator 37 with an output of the regulating-valve-opening-target-setting circuit 36, which output has been preset by an operator, (for instance, in the case of four regulating valves, a fully open position of the third or second regulating valve is selected.), and then the derivation thus derived is introduced into a proportional control circuit 38, whose output is then added to the main steam pressure programming circuit 33 so as to compensate for a target value shown by the main steam pressure program.

Assume that a preset load value is changed from a certain load level to other load level.

Compensation is made to the main steam pressure program in a manner that firstly the opening of each regulating valve (cam angle) is changed so as to bring an actual load to a preset load level, and then the opening of the regulating valve which has been deviated from a target value is brought back to the target value, so that the main steam pressure may be adjusted. Eventually, however, the load and the regulating valve opening are brought into coincidence with target values, so the so-called sliding pressure type running of a plant can be achieved.

Figure 2:
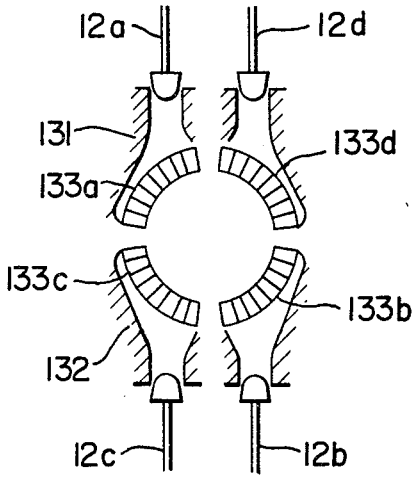
FIG. 2 is a cross-sectional view showing the arrangement of portion of the plant in the neighborhood of regulating valves.

FIG. 2 is a cross-sectional, detailed view of a portion of the regulating valve shown in FIG. 1, taken along the line perpendicular to a turbine shaft. Shown at 131 is an upper casing of a turbine, and at 132 a lower casing.

A first nozzle portion which produces steam flowing to rotor blades of the turbine are divided into four segments along the circumference thereof, thereby providing nozzle boxes, respectively. Shown at 133-*a*, 133-*b*, 133*c*, 133-*d* are first, second, third, fourth nozzle boxes, respectively. A single regulating valve is provided in each of nozzle boxes, thereby adjusting the flow rate of steam to be supplied to the nozzle box. Shown at 12*a*, 12*b*, 12*c*, 12*d* are first, second, third and fourth regulating valves. The arrangement of respective regulating valves are so designed as to be able to as uniformly heat the casings as possible, when the regulating valves are opened one after another.

Figure 3:
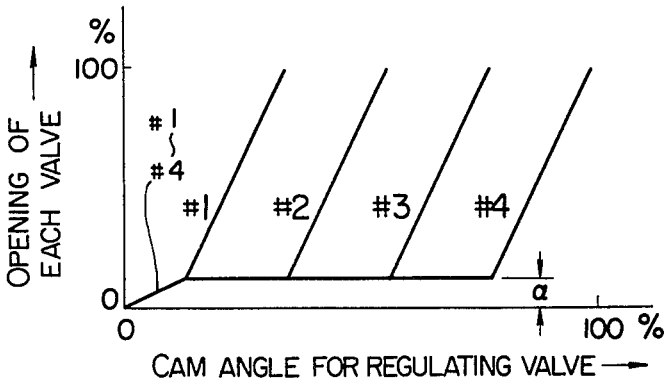
FIG. 3 is a view illustrative of opening characteristics of respective regulating valves in one embodiment of the invention.

FIG. 3 is a graph showing the relationship between the characteristics of openings of respective regulating valves and an angle of rotation of the cam shaft shown in FIG. 1, i.e., a regulating valvepositioning signal which is supplied as a hydraulic pressure signal from the governor 16. As the valve positioning signal is built up from a 0 level, the regulating valves are all opened at a time in a range up to an opening $\alpha$, after which first, second, third, and fourth valves are opened from an opening $\alpha$ to a full opening one after another. The opening $\alpha$ as used herein is referred to as a warming opening, and should be such an opening sufficiently large for warming the neighborhood of the nozzle portion, until the respective regulating valves are opened, one after another.

As is clear from the foregoing, respective regulating valves according to the present invention are all opened to their warming openings, before respective valves are opened one after another, so that even in case control signal for an opening of each regulating valve or valve positioning signal fluctuates in the neighborhood of a valve change-over point on a short cycle, there may be avoided a premature failure and errosion in valve seats of regulating valves due to thermal stresses.

Since the first to fourth valves are first opened at a time, there arises to some degree in a lowering efficiency of a plant, when resorting to a nozzle governing system alone. However, by suitably selecting the value, a degree of lowering in efficiency may be rendered negligible.

Figure 4:
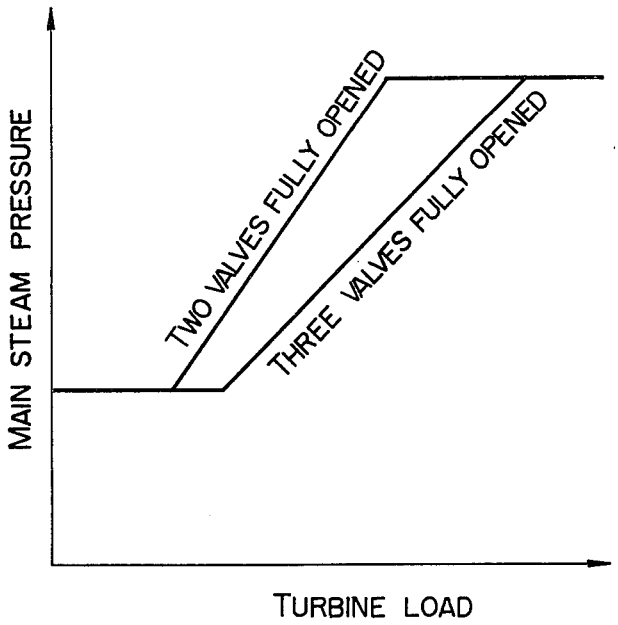
FIG. 4 is a view illustrative of programming characteristics in setting the main steam pressure.

Meanwhile, the regulating-valve-opening-target-setting circuit 36 shown in FIG. 1 may be so designed that, for instance, like the sliding pressure power plant employing fully opened two valves or fully opened three valves, a valve opening target value may be selectively set to a given change-over point of a valve. In this case, a main steam pressure target value corresponding to a load commensurate with each of the selected-valve-opening-target values, as shown in FIG. 4, is programmed in the main-steam-pressure-programming circuit 33 so as to allow the selection of the main-steam-pressure-target value in response to the selected valve opening.

Figure 6:
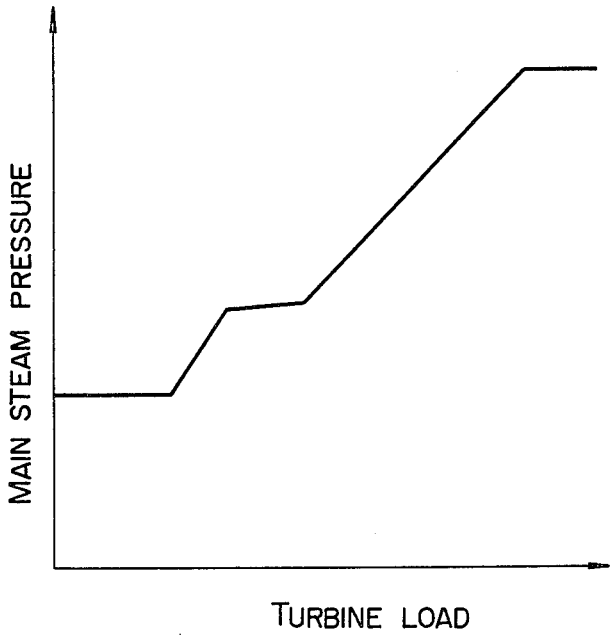
FIG. 6 is a view illustrative of the setting characteristics for target values for openings of regulating valves in the embodiment of FIG. 5.
Figure 5:
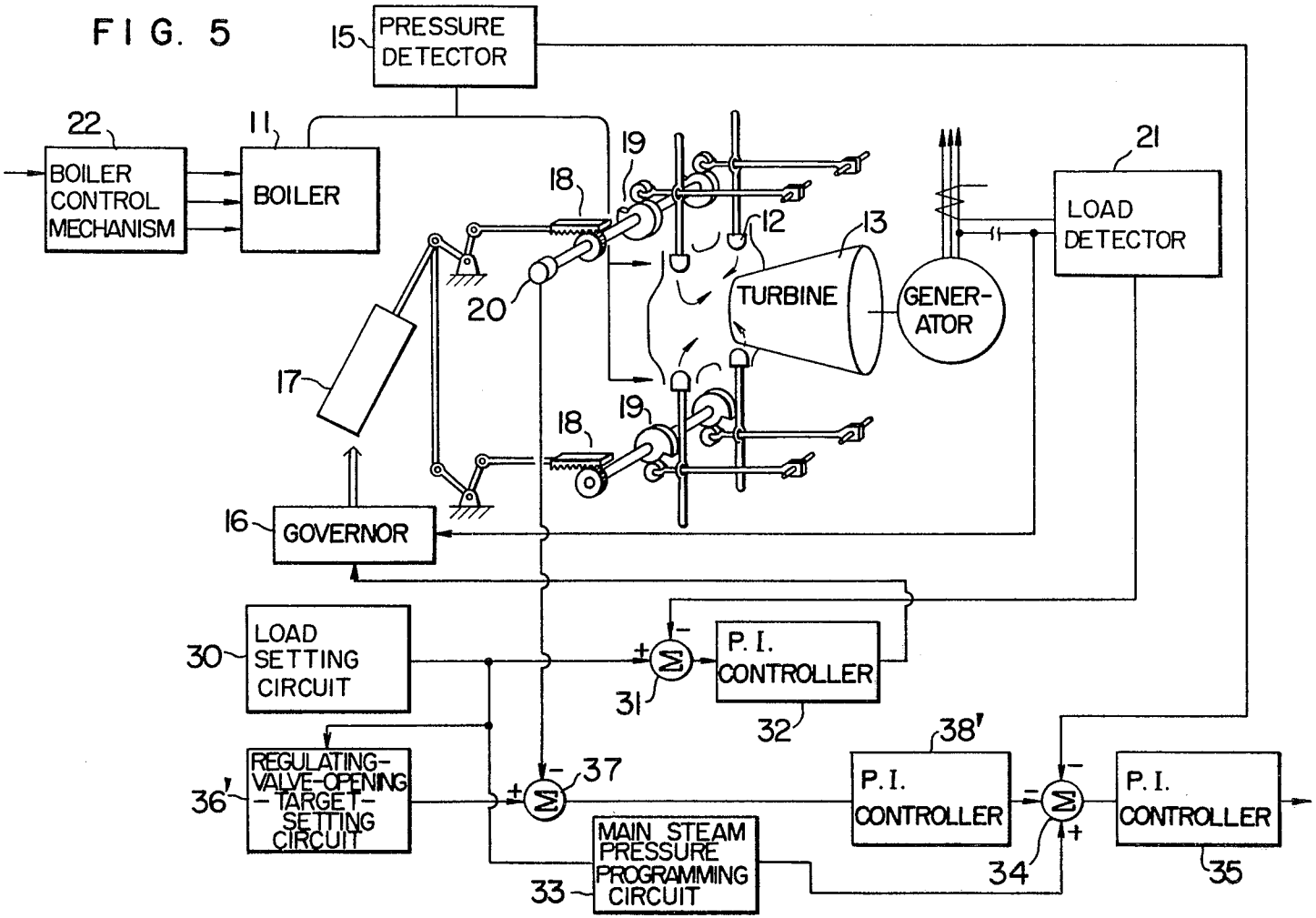
FIG. 5 is a block diagram illustrative of another embodiment of the invention.

FIG. 5 shows another embodiment of the present invention. In this embodiment, a load demand supplied from the load setting circuit is fed into a regulating-valve-opening-setting circuit 36′, so that a target value of an opening of a regulating valve may automatically be determined in response to the magnitude of a load demand. The characteristic of a target value to be set for a regulating-valve-opening relative to the load demand is so determined that the efficiency of a plant in its entirety be raised as high as possible. FIG. 6 shows one of examples thereof, i.e., a characteristic such that several regulating valves are brought to their fully open positions in a specific load range.

In addition, in case the regulating-valve-opening-target value is determined primarily for a load demand, then the main-steam-pressure target value to be programmed in the main steam pressure programming circuit 33 may be likewise primarily determined, depending on the load demand.

Figure 7:
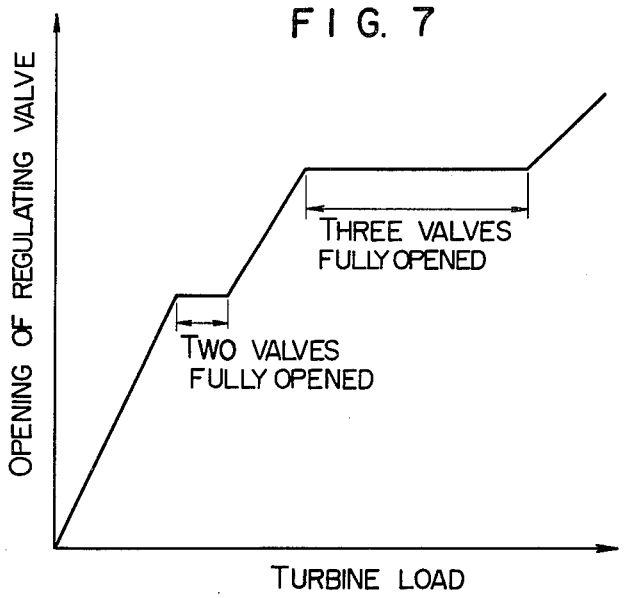
FIG. 7 is a view illustrative of programming characteristics in setting the main steam pressure, when setting target values for openings of regulating valves shown in FIG. 6.

FIG. 7 shows a characteristic of the main steam pressure program relative to the setting characteristic of the regulating valve opening, as shown in FIG. 6. In addition, in case a target value for the regulating-valve-opening is determined in response to a load, then the main steam pressure program may be corrected, until a diviation of the actual value of a regulating valve opening from the target value is lowered to zero, with the result that the circuit 38′ adapted to correct the value of the main-steam-pressure program may be provided in the form of a propotional plus integral control circuit.

According to the embodiments shown in FIGS. 5 to 7, optimum target values for the main steam pressure, and regulating valve openings are automatically set in response to load demands, and hence there may be achieved a highly efficient running of a plant, regardless of any load range selected.

Figure 8:
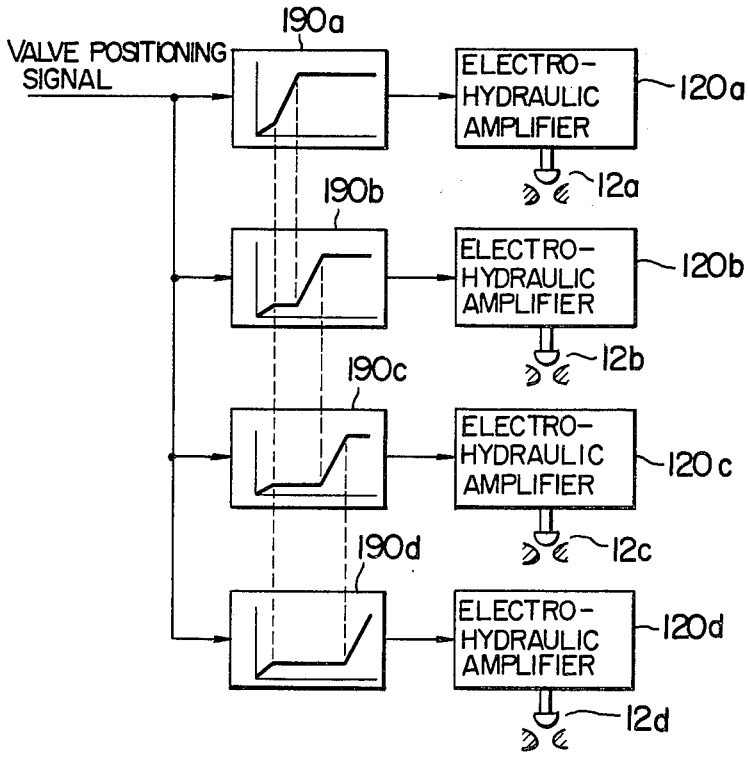
FIG. 8 is a block diagram illustrative of the regulating-valve-driving portion in still anotehr embodiment of the invention.

In the embodiments which have been described thus far, there are provided valve-driving mechanisms, in each of which a piston is driven according to a hydraulic signal generated from a governor so as to drive a cam shaft of a regulating valve for operating the regulating valve. In addition, the opening characteristic of each regulating valve depends on the shape of a cam. However, as an alternative, another mechanism may be employed in the present invention, in which opening characteristics of two or more regulating valves may be suitably determined for a valve positioning signal. FIG. 8 shows a block diagram, in which the so-called electro-hydraulic control (EHC) is adopted. Shown at 190*a* to 190*b* are function generators provided for respective regulating valves, which produce outputs as shown, respectively, in response to valve positioning signals supplied as electric signals. Respective outputs of the function generators are fed to the electro-hydraulic amplifiers 120*a* to 120*b*, so that openings of regulating valves 12*a* to 12*d* are defined by means of a hydraulic servo-mechanism.

What is claimed is:

1. A governing system for use in a sliding-pressure turbine power plant, wherein steam is introduced from a boiler via two or more regulating valves to a turbine so as to drive said turbine, comprising;

first means for generating a main-steam-pressure-target value in response to a given function corresponding to a load demand;

second means for setting a target value for the opening of each regulating valve;

third means for generating a signal to correct an output of said first means, depending on a deviation of the actual opening from a target value of the opening of each regulating valve;

fourth means for controlling the operating mechanism of a boiler in a manner that a corrected value of an output of said first means according to an output of said third means may be brought into coincidence with a detected value of the main steam pressure;

fifth means for generating a valve positioning signal, commensurate with a deviation of an actual load from a load demand;

sixth means for driving respective regulating valves in a manner that two or more regulating valves may be opened at least to respective warming openings at a time, commensurate with the magnitude of an output of said fifth means, after which respective regulating valves may be opened one after another in an opening range beyond said warming opening.

2. A governing system as set forth in claim 1, wherein said sixth means incudes a hydraulic mechanism for defining a cam shaft angle according to a valve positioning signal; and a cam mechanism having a cam for each regulating valve, said cam being of such a shape that all regulating valves may be opened at a time until the openings of two or more regulating valves reach warming openings, respectively, in response to said cam shaft angles, and after which said regulating valves are opened one after another in an opening range beyond said warming openings.

3. A governing system as set forth in claim 1, wherein said sixth means includes: a function generator provided for each of said two or more regulating valves and generating an electric signal representing the opening of each regulating valve, upon receiving of a valve positioning signal; and an electro-hydraulic mechanism which defines the position of each regulating valve according to an output of each of said function generators.

4. A governing system as set forth in any one of claim 1 to 3, wherein said first means selectively define a function set for a target value for a main steam pressure, commensurate with an output of said second means, thereby generating a target value for said main steam pressure.

5. A governing system as set forth in anyone of claims 1 to 3, wherein said second means automatically generates a target value for an opening of each regulating valve in response to a given function, commensurate with a load demand.

6. A governing system as set forth in claim 5, wherein said third means is provided in the form of a proportional plus integral control circuit.

7. A governing system as set forth in anyone of claims 1 to 3, wherein said second means may suitably select a point where some of two or more regulating valves may be fully opened, irrespective of a load demand.

* * * * *